US007513310B2

(12) United States Patent
Fossli

(10) Patent No.: US 7,513,310 B2
(45) Date of Patent: Apr. 7, 2009

(54) METHOD AND ARRANGEMENT FOR PERFORMING DRILLING OPERATIONS

(75) Inventor: Borre Fossli, Oslo (NO)

(73) Assignee: Ocean Riser Systems AS, Oslo (NO)

( * ) Notice: Subject to any disclaimer, the term of this patent is extended or adjusted under 35 U.S.C. 154(b) by 242 days.

(21) Appl. No.: 10/549,059

(22) PCT Filed: Mar. 12, 2004

(86) PCT No.: PCT/NO2004/000069

§ 371 (c)(1),
(2), (4) Date: Sep. 13, 2005

(87) PCT Pub. No.: WO2004/085788

PCT Pub. Date: Oct. 7, 2004

(65) Prior Publication Data

US 2006/0169491 A1 Aug. 3, 2006

(30) Foreign Application Priority Data

Mar. 13, 2003 (NO) ..... 20031168

(51) Int. Cl.
*E21B 29/12* (2006.01)

(52) U.S. Cl. ..... 166/358; 175/5; 175/171; 175/207

(58) Field of Classification Search ..... 166/358, 166/357, 368; 175/5–7, 66, 70, 206, 207, 175/171, 57

See application file for complete search history.

(56) References Cited

U.S. PATENT DOCUMENTS 2,929,610 A * 3/1960 Stratton ..... 166/354
3,252,528 A * 5/1966 Nicolson ..... 166/352
3,256,936 A * 6/1966 Johnson et al. ..... 166/354

(Continued)

FOREIGN PATENT DOCUMENTS

DE 1634475 8/1970

(Continued)

OTHER PUBLICATIONS

PCT International Search Report dated Oct. 8, 2004 of International Application No. PCT/NO2004/000069 filed Mar. 12, 2004.

(Continued)

*Primary Examiner*—Thomas A Beach
(74) *Attorney, Agent, or Firm*—Vern Maine & Associates

(57) ABSTRACT

An arrangement and a method to control and regulate the bottom hole pressure in a well during subsea drilling at deep waters: The method involves adjustment of a liquid/air interface level in a drilling riser. The arrangement comprises a drilling riser with an outlet at a depth below the water surface. The outlet is connected to a subsea pumping system with a flow return conduit back to a drilling vessel. The intention of the system is to transport the drilling fluid and the formation particles to the surface on the drilling unit prior to setting structural pipe on the seabed and when drilling at least one hole section after the first surface structural casing have been set. The apparatus is used in order to drill all surface hole sections with the riser installed in order to avoid "pump & dump" procedures and to recover all mud and chemicals.

10 Claims, 2 Drawing Sheets

U.S. PATENT DOCUMENTS

| | | | | | |
|---|---|---|---|---|---|
| 3,322,191 | A | * | 5/1967 | Bullard | 166/352 |
| 3,426,844 | A | * | 2/1969 | McDaniel | 166/358 |
| 3,519,071 | A | * | 7/1970 | Word, Jr. | 166/351 |
| 3,603,409 | A | | 9/1971 | Watkins | |
| 3,621,910 | A | * | 11/1971 | Sanford et al. | 166/335 |
| 3,732,143 | A | * | 5/1973 | Joosse | 175/6 |
| 3,782,460 | A | * | 1/1974 | Skinner | 166/338 |
| 3,815,673 | A | * | 6/1974 | Bruce et al. | 166/359 |
| 3,833,076 | A | | 9/1974 | Griffin, III | |
| 3,963,077 | A | | 6/1976 | Faulkner | |
| 4,046,191 | A | | 9/1977 | Neath | |
| 4,055,224 | A | | 10/1977 | Wallers | |
| 4,063,602 | A | | 12/1977 | Howell et al. | |
| 4,091,881 | A | * | 5/1978 | Maus | 175/7 |
| 4,099,583 | A | * | 7/1978 | Maus | 175/7 |
| 4,210,208 | A | | 7/1980 | Shanks | |
| 4,216,835 | A | * | 8/1980 | Nelson | 175/10 |
| 4,220,207 | A | | 9/1980 | Allen | |
| 4,224,988 | A | | 9/1980 | Gibson et al. | |
| 4,291,772 | A | * | 9/1981 | Beynet | 175/5 |
| 4,511,287 | A | * | 4/1985 | Horton | 405/204 |
| 4,646,844 | A | | 3/1987 | Roche et al. | |
| 4,719,937 | A | | 1/1988 | Roche et al. | |
| 4,759,413 | A | * | 7/1988 | Bailey et al. | 175/6 |
| 4,813,495 | A | * | 3/1989 | Leach | 175/6 |
| 5,184,686 | A | * | 2/1993 | Gonzalez | 175/5 |
| 5,727,640 | A | | 3/1998 | Gleditsch | |
| 5,848,656 | A | | 12/1998 | Mmoksvold | |
| 6,102,673 | A | * | 8/2000 | Mott et al. | 417/392 |
| 6,263,981 | B1 | | 7/2001 | Gonzalez | |
| 6,276,455 | B1 | | 8/2001 | Gonzalez | |
| 6,328,107 | B1 | * | 12/2001 | Maus | 166/335 |
| 6,401,823 | B1 | * | 6/2002 | Gonzalez et al. | 166/319 |
| 6,415,877 | B1 | | 7/2002 | Fincher et al. | |
| 6,454,022 | B1 | | 9/2002 | Sangesland et al. | |
| 6,457,529 | B2 | * | 10/2002 | Calder et al. | 166/368 |
| 6,474,422 | B2 | * | 11/2002 | Schubert et al. | 175/69 |
| 6,536,540 | B2 | * | 3/2003 | de Boer | 175/70 |
| 6,578,637 | B1 | * | 6/2003 | Maus et al. | 166/350 |
| 6,648,081 | B2 | | 11/2003 | Fincher et al. | |
| 6,745,857 | B2 | * | 6/2004 | Gjedebo | 175/69 |
| 6,802,379 | B2 | * | 10/2004 | Dawson et al. | 175/38 |
| 6,843,331 | B2 | * | 1/2005 | de Boer | 175/70 |
| 6,854,532 | B2 | * | 2/2005 | Fincher et al. | 175/5 |
| 6,926,101 | B2 | * | 8/2005 | deBoer | 175/70 |
| 6,953,097 | B2 | * | 10/2005 | Seyffert | 175/66 |
| 6,966,367 | B2 | * | 11/2005 | Butler et al. | 166/105 |
| 6,966,392 | B2 | * | 11/2005 | deBoer | 175/70 |
| 6,981,561 | B2 | * | 1/2006 | Krueger et al. | 175/312 |
| 7,027,968 | B2 | * | 4/2006 | Choe et al. | 703/10 |
| 7,044,237 | B2 | * | 5/2006 | Leuchtenberg | 175/48 |
| 7,055,623 | B2 | * | 6/2006 | Calderoni et al. | 175/6 |
| 7,066,247 | B2 | * | 6/2006 | Butler et al. | 166/105 |
| 7,090,036 | B2 | * | 8/2006 | deBoer | 175/70 |
| 7,093,662 | B2 | * | 8/2006 | deBoer | 166/358 |
| 7,174,975 | B2 | * | 2/2007 | Krueger et al. | 175/57 |
| 7,234,546 | B2 | * | 6/2007 | Vincent et al. | 175/171 |
| 2004/0238177 | A1 | | 12/2004 | Fossli | |

FOREIGN PATENT DOCUMENTS

| | | | |
|---|---|---|---|
| FR | 2787827 | | 6/2000 |
| NO | 305138 | B1 | 4/1999 |
| NO | 306174 | B1 | 9/1999 |
| NO | 312915 | B1 | 2/2001 |
| WO | 99/18327 | A1 | 4/1999 |
| WO | 0039431 | | 7/2000 |
| WO | 03023181 | A1 | 3/2003 |

OTHER PUBLICATIONS

Nowegain International Search Report dated Aug. 18, 2003 of International Application No. 20031168 filed Mar. 12, 2004.

NO Search Report dated Feb. 15, 2005 of Patent Application No. PCT/NO02/00317 filed Sep. 10, 2002.

* cited by examiner

METHOD AND ARRANGEMENT FOR PERFORMING DRILLING OPERATIONS

RELATED APPLICATIONS

This application is a national phase application of PCT Application Serial Number PCT/NO2004/000069 filed Mar. 12, 2004, which, in turn, claims priority to Norwegian Application Ser. No. NO 2003 1168, filed Mar. 13, 2003. Each of these applications is herein incorporated in its entirety by reference.

FIELD OF THE INVENTION

The present invention relates to a particular arrangement for use when drilling a hole in the ocean floor from an offshore structure that floats or is connected to the seabed by other means. More particularly, it describes a drilling riser system so arranged that the pressure in the bottom of an underwater borehole can be controlled so that the hydrostatic pressure inside the riser is equal to or slightly below that of seawater at that depth and not higher than the formation strength of the weakest section of the borehole.

BACKGROUND OF THE INVENTION

In all present drilling operations to date in offshore drilling with a semi submersible rig or drillship, this top hole drilling is performed riserless. The debris and drill cuttings are until now handled in two different ways. 1) The returns are discharged and flow freely into seawater as the drilling fluid and formation debris are pumped up the hole. The drilling fluid and formation will then be spread out on the seabed around the borehole. 2) After the well is spudded and the first structural/conductor casing is set, some equipment is run on the drill string that will connect to a suction hose and a pump placed on seabed. The majority of the drill fluid and cuttings is then sucked from the top of the hole and pumped away from the drill site to a different location on seabed. This cutting transport system will not remove the cuttings from the seabed but just re-locate them.

Lately concepts have been presented that will pump the return from seabed up to the drilling platform thorough a separate hose with the help of a pumping system on seabed after the structural or conductor casing has been set. This is indicated in patent NO312915. Here the pump is place on the seabed and no drilling riser is installed.

SUMMARY OF THE INVENTION

This invention defines a particular novel arrangement, which can be used for drilling a subsurface hole without having to discharge subsurface formations to the surrounding seabed when drilling the hole prior to installing the surface conductor (structural) steel pipe and prior to installing the surface casing, at which point the riser and subsea BOP is installed in conventional drilling. By performing drilling operations with this novel arrangement as claimed, all formation and soil will be circulated and pumped up to the surface vessel or platform. The arrangement comprises the use of prior known art but is arranged so that new drilling methods can be achieved. By arranging the various systems coupled to the drilling riser in this particular way, totally new and never before used methods can be performed.

Referring to the figures, experience from drilling operations in upper soil layers has shown that the subsurface formations to be drilled usually have very low fracture strength (301) close to the seabed and it is often close to that of seawater (302). This dictates that drilled formation will have to be disposed on seabed since the formation strength is not high enough to support the hydrostatic pressure from the combined effect of drilling mud and the suspended drilled formation solids in a drilling riser up to the drilling platform (304). This is the reason it is not possible to install a conventional drilling riser and take the returns to the surface, before a casing is set so deep that it will isolate the weaker formation and that the soil strength is high enough to support a liquid column of water and formation cuttings (debris) up to the drilling unit above sea level.

The two uppermost sections of the hole are normally drilled riserless, without a drilling riser. Often this "pump and dump" procedure cause for excessive amount of drilling mud, barite weighting materials, formation solids and other chemicals to be dumped to the ocean. Besides this practice being expensive it is also a wasteful process that can be harmful to marine life on the ocean floor.

In deeper waters as the hole deepens, the difference between the formation pore pressure and the formation fracture pressure remains low. The fracture gradient is so low that it can not support the hydrostatic pressure from a full column of seawater and formation cuttings up to the drilling platform. In addition to the static hydraulic pressure acting on the formation from a standing column of fluid in the well bore there are also the dynamic pressures created when circulating fluid through the drill bit. These dynamic pressures acting on the bottom of the hole are created when drill fluid is pumped through the drill bit and up the annulus between the drill string and formation. The magnitude of these forces depends on several factors such as the rheology of the fluid, the velocity of the fluid being pumped up the annulus, drilling speed and the characteristics of the well bore/hole. Particularly for smaller diameter hole sizes these additional dynamic forces can become significant. Presently these forces are controlled by drilling relatively large holes thereby keeping the annular velocity of the drilling fluid low and by adjusting the rheology of the drilling fluid. This new pressure seen by the formation in the bottom of the hole caused by the drilling process is often referred to as Equivalent Circulating Density (ECD).

Since this ECD effect can be neutralized by the system as described in patent application PCT/NO02/00317 the surface hole can be drilled deeper than with conventional drilling methods. This is an advantage since the next section can also be drilled deeper hence it is possible to the drill the well with fewer casings if the surface casing can be set deeper. Hence considerable economic effects can be expected from drilling the surface hole deeper.

The new method presented here will also allow for the riser to be run before setting any casings. The reason for this possibility is that the hydrostatic pressure at the bottom of the riser can be regulated to the same or less than that of seawater from sea level, regardless of the fluid density inside the drilling riser. This is achieved by having an outlet on the riser below the surface of the water that is connected to a pump system that will be able to regulate the liquid level inside the drilling riser to a depth below sea level. In this particular way will it be possible to pump drilling fluid (mud) through the drill string and up the annulus between the riser and the drill string together with formation cuttings without fracturing or loosing returns caused by the weak topsoil formations.

Below are some aspects the present invention will be used for.

In one aspect the present invention in a particular combination gives rise to new, practically feasible and safe methods of drilling the surface hole deeper with the riser installed from floating structures. In this aspect, benefits over the prior art are achieved. More precisely the invention gives instructions on how to drill and control the hydraulic pressure exerted on the formation by the drilling fluid at the bottom of the hole being drilled by varying the liquid level in the drilling riser.

With this novel invention, both kick and handling of hydrocarbon gas can be safely and effectively controlled. It is possible to add a surface BOP on top of the drilling riser (410)

Since the pressure in the end of the riser can be defined by the density of the liquid and the vertical height of the liquid column, the surface structural conductor can be run on the end of the riser and be drilled/undereamed or jetted in place with returns being circulated to the surface with the help of the Low Riser Return System (LRRS). No cuttings or formation is being deposited on the seabed or to the ocean.

Once the structural conductor is jetted in place the riser is disconnected at LRMP (233) and the telescope joint (221) removed and the riser lengthened. The riser is reconnected and the second surface hole for the surface casing can be drilled with drilling mud. All returns and mud will be circulated to surface with the LRRS. Since the bottom hole pressure can be designed to stay below the fracture pressure of the formation being drilled, the surface hole can be drilled deeper.

After the structural casing is in place a surface BOP can be installed on top of the riser. The BOP will be used in case of shallow pockets of hydrocarbons are encountered and hydrocarbons are circulated into the riser when drilling the hole for the surface casing. There may be at least one choke line in the upper part of the drilling riser of equal or greater pressure rating than the drilling riser. By incorporating the above features a well functioning system will be achieved that can safely perform drilling operations of the top two hole sections. By having a surface blowout preventer on top of the drilling riser, all hydrocarbons can safely be bled off through the drilling rig's choke line manifold system.

In one aspect the present invention overcomes many disadvantages of other attempts and meets the present needs by providing methods and arrangements whereby the fluid-level in the riser can be dropped below sea level and adjusted so that the hydraulic pressure in the bottom of the hole can be controlled by measuring and adjusting the liquid level in the riser in accordance with the dynamic drilling process requirements. Due to the dynamic nature of the drilling process the liquid level will not remain steady at a determined level but will constantly be varied and adjusted by the pumping control system. A pressure control system controls the speed of the subsea mud lift pump and actively manipulates the level in the riser so that the pressure in the bottom of the well is controlled as required by the drilling process. With the methods described it is possible to regulate the pressure in the bottom of the well without changing the density of the drilling fluid.

The ability to control pressures in the bottom of the hole and at the same time and with the same equipment being able to contain and safely control the hydrocarbon pressure on surface makes the present invention and riser system completely new and unique.

The method of varying the fluid height can also be used to increase the bottom-hole pressure instead of increasing the mud density. This means that the surface hole can be drilled at an angle/different than the riser while controlling the bottom hole pressure. This is not easily achieved with a conventional riser or achieved drilling riserless due to problems with hole stabilities when drilling with un-weighted seawater in an angularly deviated borehole hole.

Normally as drilling takes place deeper in the formations the pore pressure will also vary. In conventional drilling operation the drilling mud density has to be adjusted. This is time-consuming and expensive since additives have to be added and is discharged out to the sea without being able to reclaim the mud and chemicals. With the LRRS system the mud will be reclaimed at surface hence a more purpose fit drilling mud can be used which will drill a more gauged hole and better samples and cores can be collected.

FIG. 1 a schematic overview of the arrangement, including a depth versus pressure graph overlay.

EXPLANATION OF THE FIGURES

The (drilling) riser tube 201 has a lower outlet between the sea level and ocean floor with valves 204 that will divert the fluid in the riser tube into the submersible pump system which will pump the fluid and solids back up to the surface.

By being able to drop the air/liquid level 210 in the riser to a level below sea level, it is also possible to create a pressure inside said riser which is below that of seawater, which can be seen from gradient 305 which can be below that of gradient 302 which is seawater pressure gradient from sea level 200. This implies that seawater will flow into the end of the riser tube up into the lower outlet of the riser tube into the subsea pump 202 which will pump the content through the return conduit 220 back to a surface vessel.

Figure 1:
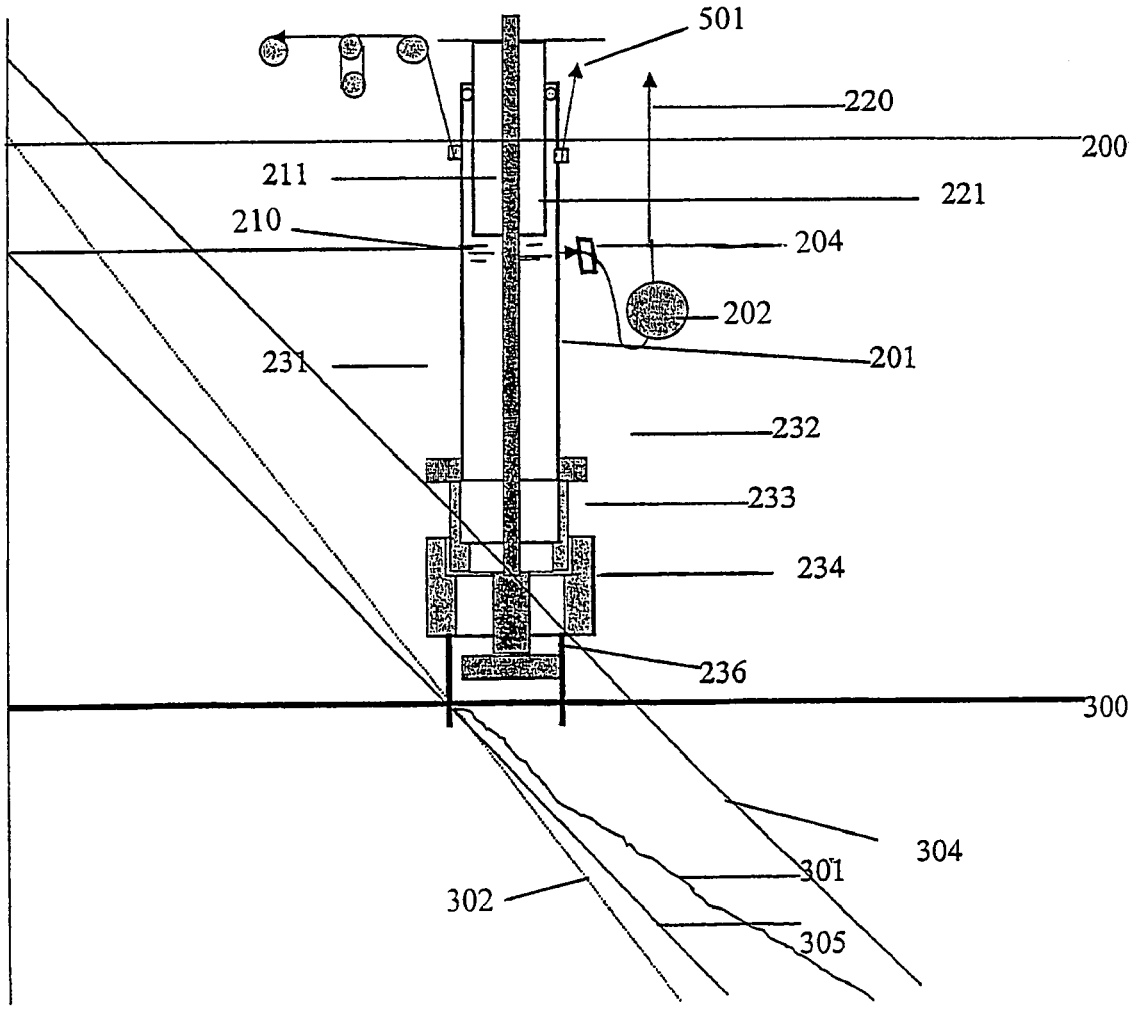

When starting the drilling operation from a floating vessel the first structural conductor 236 can be run on the end of the riser tube 201. The conductor housing 234 is connected to the surface structural conductor and the riser connected to the conductor housing 234 with a pin connector 233. The structural conductor is lowered into the seabed prior to running the drill string 211. When the drill string 211 is run inside the riser 201 down to the seafloor 300, when pumping through the drill string up the inside of the riser the pressure inside the riser at seabed is regulated to just below that of seawater at that depth (gradient 305) by lowering or adjusting the air/liquid level 210 inside the riser tube 201.

Figure 2:
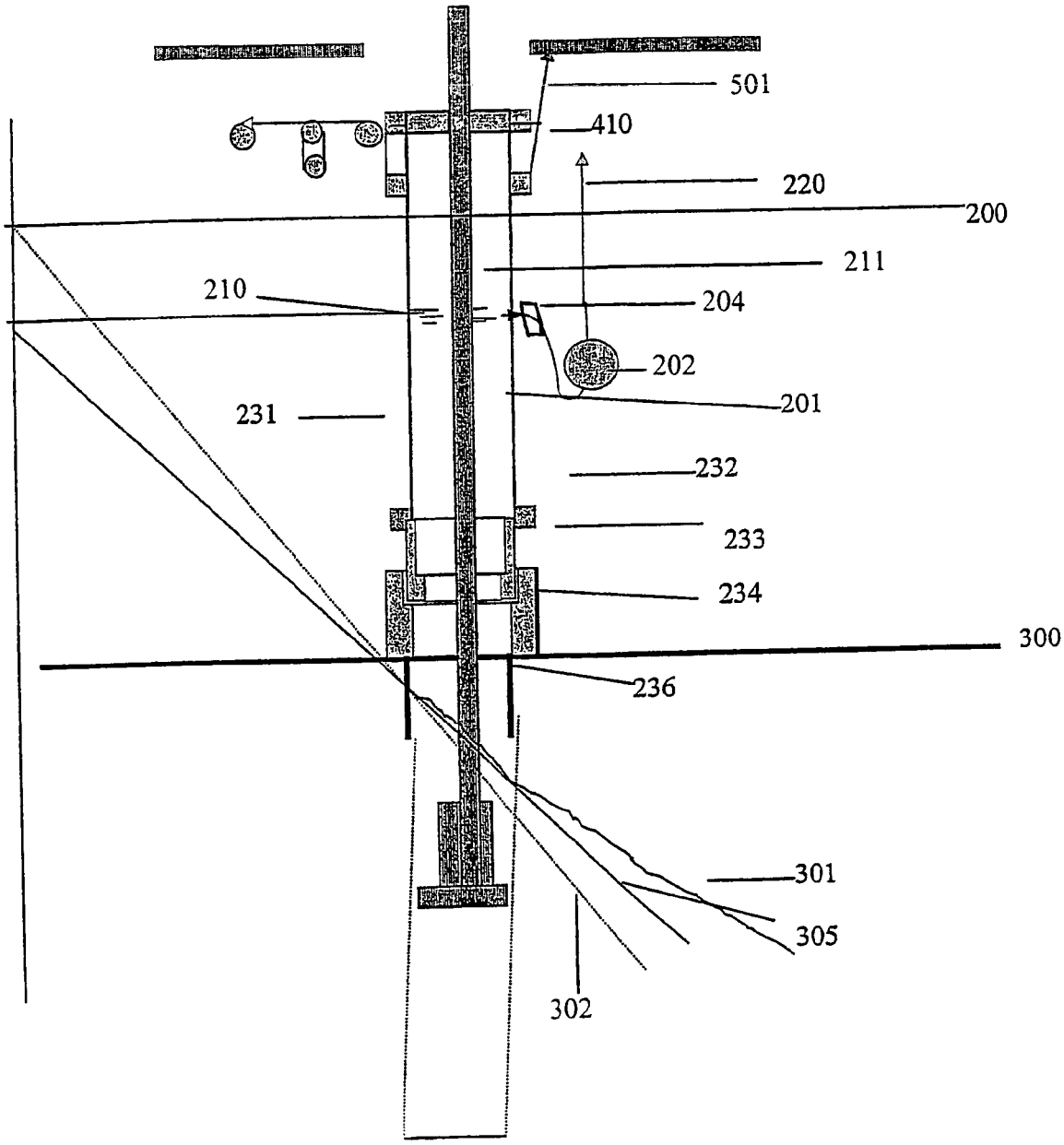

The formation soils being removed by the drill bit are pumped up to surface by the pump system 202. As the hole deepens the riser and structural conductor is lowered by help of the riser tensioning system 501 until the structural conductor housing 234 is at an appropriate height above seabed as shown in FIG. 2. In the process of removing soils from the borehole the pressure 305 in the hole due to this operation can be controlled by regulating level 210 of the liquid/air inside riser 201 to lie between that of the pressure due to seawater gradient 302 and the soil fracture gradient 301. As can be seen by FIG. 1, bringing the returns from the well all the way back to the surface as in conventional drilling would not be possible. The hydrostatic pressure from the drilling fluid gradient 304 would fracture the weak formation of the soils, gradient 301 and the level 210 would not reach back to surface before the returns would be lost to the shallow subsurface soils.

Further application of this system would include but not be limited to removal of shallow seabed soils and particles on the ocean floor as in seabed mining. Seawater will flow into the riser tube and transport any solids in suspension back up to the surface by the aid of the subsea pump system 202.

The invention claimed is:

1. A method for starting a surface hole in a seabed, comprising:

using a drilling system comprising a structural conductor attached to a drilling riser suspended from a drilling platform whereby a lower end of the structural conductor extends to the seabed, the drilling riser being vented to atmosphere, a drilling string disposed within the drilling riser, the drilling riser comprising an outlet at a depth below the water surface where the outlet is connected to a pumping system situated on or above the seabed and below the water surface, the pumping system having a return conduit running to the surface, the drilling system further comprising a pressure control system configured for controlling pressure within the lower end of the structural conductor by operation of the pumping system to control fluid level in the riser;

drilling a first section of a surface hole in a seabed while operating the pumping system so as to maintain a fluid level in the riser corresponding with a pressure within the lower end of the structural conductor equal or lower than the higher of sea level pressure and soil fracture pressure present at the lower end of the structural conductor, while pumping fluids and cuttings from the first section of the surface hole through the structural conductor into the drilling riser and to the surface via the outlet in the riser and the pumping system; and lowering the structural conductor into the first section of the surface hole.

2. The method of claim 1, further comprising:

drilling a second section of the surface hole in the seabed and while drilling, operating the pumping system so as to maintain the fluid level in the riser corresponding with a pressure within the lower end of the structural conductor equal or lower than the soil fracture pressure at the lower end of the structural conductor, while pumping fluids and cuttings from the second section of the surface hole through the structural conductor into the drilling riser and to the surface via the outlet in the riser and the pumping system.

3. A method for starting a surface hole in a seabed, comprising:

using a system comprising a structural conductor attached to a drilling riser suspended from a drilling platform whereby a lower end of the structural conductor extends to the seabed, the drilling riser being vented to atmosphere, a drilling string disposed within the drilling riser, the drilling riser comprising an outlet at a depth below the water surface where the outlet is connected to a pumping system situated on or above the seabed and below the water surface, the pumping system having a return conduit running to the surface, the system further comprising a pressure control system configured for controlling pressure within the lower end of the structural conductor by operation of the pumping system to control fluid level in the riser;

drilling a first section of a surface hole in a seabed while operating the pumping system so as to maintain a fluid level in the riser corresponding with a pressure within the lower end of the structural conductor equal or lower than the higher of sea level pressure and soil fracture pressure present at the lower end of the structural conductor, while pumping fluids and cuttings from the first section of the surface hole through the structural conductor into the drilling riser and to the surface via the outlet in the riser and the pumping system;

lowering the structural conductor into the first section of the surface hole; and drilling a second section of the surface hole in the seabed and while drilling, operating the pumping system so as to maintain the fluid level in the riser corresponding with a pressure within the lower end of the structural conductor equal or lower than the soil fracture pressure at the lower end of the structural conductor, while pumping fluids and cuttings from the second section of the surface hole through the structural conductor into the drilling riser and to the surface via the outlet in the riser and the pumping system.

4. The method of claim 1, said system further comprising said pumping system with said return conduit adapted to be launched and run from a separate tender support vessel (TSV) situated near the drilling platform, said pumping said fluids and cuttings to the surface comprising pumping said fluids and cuttings to the TSV.

5. The method of claim 1, said system further comprising said drilling platform comprising one from among the group of platforms consisting of a drilling vessel, a mobile offshore drilling unit (MODU), an anchored production platform, a SPARS or Bouy form, a deep-draft floater, an articulated steel tower, a floating drilling and production vessel (FDP), and a platform fixed to seabed with tension legs (TLP).

6. The method of claim 1, said system further comprising the return conduit being connected to the drilling platform.

7. The method of claim 1, the angle of the surface hole being deviated from the angle of the riser.

8. The method of claim 1, said system further comprising said drilling riser connected to a conductor housing via a pin connector, said conductor housing connected to said structural conductor.

9. The method of claim 2, said lowering the structural conductor comprising concurrently extending the drilling riser so as to maintain the structural conductor being attached to the drilling riser.

10. A method for starting a surface hole in a seabed, comprising:

using a system comprising a structural conductor attached to a drilling riser suspended from a drilling platform whereby a lower end of the structural conductor extends to the seabed, the drilling riser being vented to atmosphere, a drilling string disposed within the drilling riser, the drilling riser comprising an outlet at a depth below the water surface where the outlet is connected to a pumping system situated on or above the seabed and below the water surface, the pumping system having a return conduit running to the surface, the system further comprising a pressure control system configured for controlling pressure within the lower end of the structural conductor by operation of the pumping system to control fluid level in the riser;

drilling a first section of a surface hole in a seabed while operating the pumping system so as to maintain a fluid level in the riser corresponding with a pressure within the lower end of the structural conductor equal or lower than the higher of sea level pressure and soil fracture pressure present at the lower end of the structural conductor, while pumping fluids and cuttings from the first section of the surface hole through the structural conductor into the drilling riser and to the surface via the outlet in the riser and the pumping system;

lowering the structural conductor into the first section of the surface hole and concurrently extending the drilling riser so as to maintain the structural conductor being attached to the drilling riser; and drilling a second section of the surface hole in the seabed and while drilling, operating the pumping system so as to maintain the fluid level in the riser corresponding with a pressure within the lower end of the structural conductor equal or lower than the soil fracture pressure at the lower end of the structural conductor, while pumping fluids and cuttings from the second section of the surface hole through the structural conductor into the drilling riser and to the surface via the outlet in the riser and the pumping system.

* * * * *

UNITED STATES PATENT AND TRADEMARK OFFICE

CERTIFICATE OF CORRECTION

PATENT NO. : 7,513,310 B2
APPLICATION NO. : 10/549059
DATED : April 7, 2009
INVENTOR(S) : Borre Fossli It is certified that error appears in the above-identified patent and that said Letters Patent is hereby corrected as shown below:

Column 3
Line 67, insert --Figure 2 a schematic diagram of and partial detail of the arrangement of Figure 1.--

Column 5
Line 1, delete "level", insert --water--
Line 40, delete "level", insert --water--

Column 6
Line 41, delete "level", insert --water--

Signed and Sealed this

First Day of June, 2010

David J. Kappos

David J. Kappos
*Director of the United States Patent and Trademark Office*